US008607674B2

(12) United States Patent
Riestra

(10) Patent No.: US 8,607,674 B2
(45) Date of Patent: Dec. 17, 2013

(54) MANUALLY DRIVEN AND SELF-CONTAINED, CONTROLLED TIGHTENING HYDRAULIC WRENCH

(75) Inventor: Antonio Cami Riestra, Lleida (ES)

(73) Assignees: Luis Gerardo Oyervides Ochoa, Nuevo Leon (MX); Antonio Cami Riestra, Lleida (ES)

( * ) Notice: Subject to any disclaimer, the term of this patent is extended or adjusted under 35 U.S.C. 154(b) by 677 days.

(21) Appl. No.: 12/950,593

(22) Filed: Nov. 19, 2010

(65) Prior Publication Data

US 2011/0203425 A1 Aug. 25, 2011

(30) Foreign Application Priority Data

Feb. 22, 2010 (MX) ..... MX/a/2010/002059

(51) Int. Cl.
*B25B 23/142* (2006.01)

(52) U.S. Cl.
USPC ..... 81/467; 81/469; 81/470; 81/57.39

(58) Field of Classification Search
USPC ..... 81/54, 57.39, 57.42, 57.44, 55, 81/467–483
See application file for complete search history.

(56) References Cited

U.S. PATENT DOCUMENTS

| | | | | |
|---|---|---|---|---|
| 3,339,884 | A * | 9/1967 | Smith et al. | 251/161 |
| 5,159,987 | A * | 11/1992 | Thorp et al. | 173/176 |
| 6,467,547 | B2 | 10/2002 | Maguire et al. | |
| 6,708,778 | B2 | 3/2004 | Tokunaga | |
| 6,818,253 | B2 | 11/2004 | Kimbrell | |

* cited by examiner

*Primary Examiner* — Monica Carter
*Assistant Examiner* — Melanie Alexander
(74) *Attorney, Agent, or Firm* — Birch, Stewart, Kolasch & Birch, LLP

(57) ABSTRACT

A torque-regulated, manual drive, hydraulic wrench for tightening and loosening which doesn't require any outer element for operating, whether hydraulic pumps with respective supply hoses, control gauges, or hydraulic centers. The torque selection/regulation is performed by a circular slide rule mechanism.

8 Claims, 11 Drawing Sheets

MANUALLY DRIVEN AND SELF-CONTAINED, CONTROLLED TIGHTENING HYDRAULIC WRENCH

TECHNICAL FIELD OF THE INVENTION

Hydraulic drive wrenches for nuts or screws may be of any shape and design, particularly depending on the area where the nut is to be manipulated. Nowadays, there is a great range of sizes and designs of nut flats and screw heads which are manufactured in this way to control their maneuvering and to achieve the adequate pressure for their tightening or loosening. The use of this type of wrenches is common in industry, as well as in daily life, where a nut or screw is required to be unscrewed, loosened, screwed and tightened.

BACKGROUND OF THE INVENTION

There is a wide variety of nut drive wrenches. For example, U.S. Pat. No. 6,708,778, describes a hydraulic unit including case, a liner contained in the case, and a top cap and an opposing bottom cap plugged at the front and rear ends of the case. The unit further includes a spindle disposed in the liner and provided with a large diameter section. The large diameter section has a pair of blades with one having longer first pins and the other having shorter second pins. A first oblong cam recess and a second oblong cam recess having a second longer longitudinal axis and a shallower depth than the first recess.

During rotation of the case, the torque of the axis is increased, but the disadvantage of the cited invention is that the applied torque cannot be determined.

U.S. Pat. No. 6,467,547 describes a tool comprising a torque-dampening system. A first portion and a second portion of the tool are operably related by a torsion interface. In one embodiment, the torsion interface includes a plurality of interlaced teeth disposed on the each of the first and second portions. During relative rotation of the first and second portions, the teeth engage and "ride up" on one another, thereby forcing the first and second portions in opposite axial directions. At least one of the portions houses a flow restrictor assembly adapted to restrict fluid flow from one region to another during the axial movement of the portions. In this way, the relative rotation between portions is inhibited or reduced, for this reason the functionality of the tool includes a torque detent, however, a particular torque cannot be determined.

U.S. Pat. No. 6,818,253 describes an hydraulic power tool that in a notch has a power axis associated to the power tool, it also has a transducer adapted for measuring the torque, this transducer is mounted in the notch, or a transducer stationary portion is mounted in contactless relationship with the axis. The tool allows measuring the applied torque, however it isn't possible to preset a particular torque that is going to be applied.

As can be noted, the tools from the prior art don't include an integral regulated or controlled tightening system of manual and autonomous actuating, for previously selecting the torque to be applied.

BRIEF DESCRIPTION OF THE INVENTION

The present invention refers to a hydraulic torque wrench tool for tightening/loosening, which is achieved through a torque selection/regulation device comprising a circular slide rule calibrated for controlling the torque to be applied.

The hydraulic wrench tool of the present invention consists substantially of a main casing (1) wherein a series of components are housed, whereby, upon shifting a manual actuating lever (29), the movement of a two-speed piston (14) is made, which displaces hydraulic fluid that urges a piston (7), which finally moves forward a power piston (2). In a preferred embodiment, the tool is used for tightening/loosening flange nuts, for which the piston shaft (2) of the hydraulic wrench is coupled to a receiving support (96) of a bearing wrench (96), and to a bearing support (97). In turn, the receiving support (96) of the bearing wrench is coupled to a bearing wrench (95). In view of the above, one single person is capable of manually tightening/loosening through torque regulation the nuts of a flange of great dimensions, for example the flanges used in oil facilities.

The bearing wrench (95) is described and claimed in a patent application with the same title, which is filed concurrently to the present invention, so said bearing wrench (95) is not described in the present application.

The hydraulic wrench of the present invention is a high torque wrench, which further comprises a circular slide rule mechanism for controlling the torque to be applied, which may be used in every type of nuts and screws with the advantage of not affecting or damaging the edges of the nut flats or screw heads.

The drive hydraulic wrench for tightening and loosening with torque selection/regulation of the present invention doesn't require any external elements for operating; whether hydraulic pumps, with their corresponding supply hoses, control gauges, or hydraulic centers, that is, an autonomous hydraulic wrench.

The manual drive hydraulic wrench for tightening and loosening with torque regulation of the present invention comprises a casing (1); a manually driven lever (29) attached at one end of the casing (1), and a power piston (2) attached to the opposing end of the casing (1); a two-speed piston (14) within a casing (1); a closed-circuit four-way distributor (48) within the casing (1); wherein the piston feed stroke (14) is done through the lever thrust (29) which is attached to a support (30), the support (30) in turn pushes a spherical two-head connecting rod (15), which performs the function of ball over piston (14); the piston feed (14) that pushes an hydraulic fluid housed in a fluid accumulator (50), causing the hydraulic fluid to open the valves (13, 13C), and through a butt (16) the hydraulic fluid is supplied to a pressure valve (39), which pushes a piston (7), which in turn urges a power piston (2) causing it to go forward; and wherein the backward movement of the piston is made trough a control lever of the distributor (43), which is directed towards the position of the drive lever (29), the control lever of the distributor (43) is attached to a cam (49) which acts on a push rod (46) which in turn acts on the valve (13), while at the same time moving the valve seat support (47) backwards, resulting in the closing of the pressure circuit valve (13), and this in turn opens the return circuit.

The hydraulic fluid may be any liquid appropriate for being used in tools or hydraulic devices, for example hydraulic oil.

In an embodiment, the manual drive hydraulic wrench further comprises a torque selection and regulation device having a circular slide rule (100) mechanism; wherein the circular slide rule (100) mechanism comprises an epicycloidal planetary (35), a epicycloidal first ring gear (34), an arrangement of an epicycloidal satellite (37), a circular ruler (38) with a hole (56), a satellite axis (33) attached to the progressive circular ramp (36), a ramp/spring contact cylinder (11) with a moisturetight seal (4), a torque regulation spring (55) housing a plunger or valve piston in its interior (59) which at one of its ends has a valve closing/opening cone, sleeve valve (57), having at one of its ends a valve seat (40) and a lag hole (58); wherein the circular slide rule (38) is movable and transmits the circular movement to the progressive circular ramp (36) through a satellite (37) and an axis (33) which is attached to the circular ramp (36); wherein the circular slide rule (38) is attached to a circular ramp (36) by a set screw installed in the threaded hole (56), so that upon loosening the screw, the circular slide rule (38) may rotate by a forward or backward movement with respect to a die cut or labeled reference frame "0" in the valve block (24), whereby the hydraulic wrench may be calibrated from the outside, without having to dismount any pieces.

Selection of the torque is made by a circular slide rule mechanism supported by a epicycloidal gear reducer, in order to obtain an increased accuracy upon making the selected torque turn, besides performing the function of safe secure clamping of the chosen position, for example, a 1:2 ratio guarantees that for each revolution of the circular ruler, the forward movement over the connection ramp to the valve opening resilient element will be half, so an increased turn accuracy may be achieved. The circular slide rule may be exchanged depending on the reading intended to be obtained in Nm, lbf.ft, Kgm, through the substitution of the circular slide rule.

BRIEF DESCRIPTION OF THE DRAWINGS

The present invention will become more evident from the following description when taken in connection with the accompanying drawings, wherein.

ELEMENTS OF THE TOOL

Figure 1:
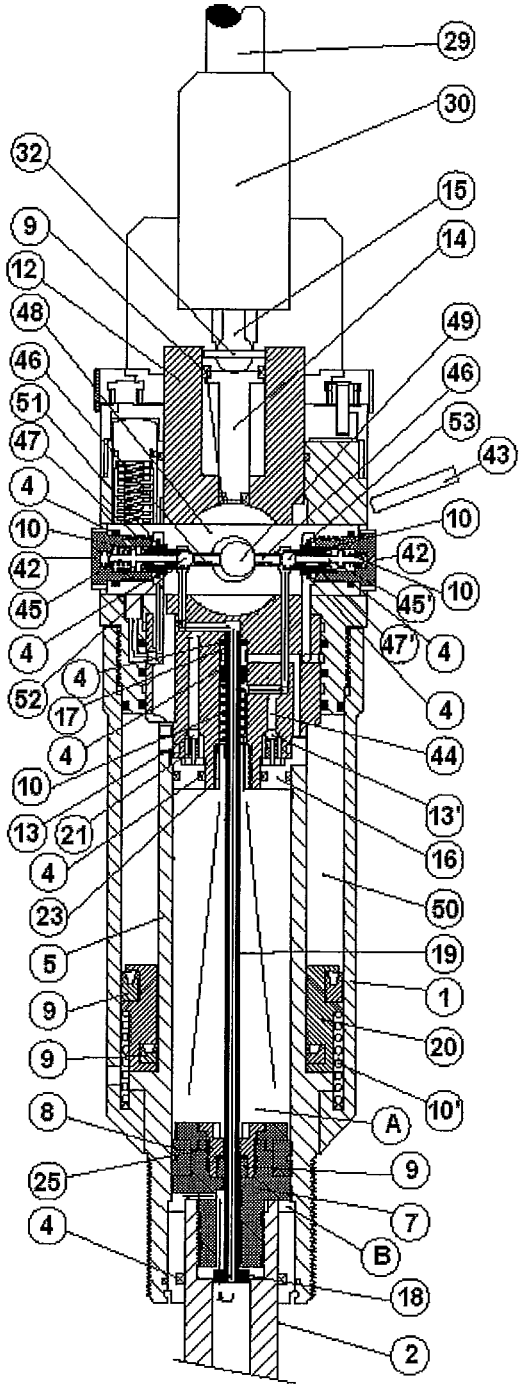
FIG. 1, shows a longitudinal cut of the casing (1) of the hydraulic wrench, in top view.

1. Casing
2. Power piston
3. Guide bush
4. Moisturetight seal
5. Piston sleeve
6. Metal guard ring
7. Piston head
8. Outer accumulator collars
9. Inner accumulator collars
10, 10' Distributor accumulator springs
11. Ramp/spring contact cylinder
12. Valve block
13, 13C. Shared valves
13A, 13B Valves
14. Two-speed piston
15. Connecting rod
16. Butt
17. Retractable bushing
18. Retractable detent
19. Retractable pipe
20. Accumulator piston
21. Valve detent
22. Piston lock washer
23. Retractable nut
24. Valve block
25. Piston head lock screw
26. Shared valve cap
27. Lever bolt
28. Safety lever pin
29. Driving lever
30. Removable lever support
31. Stationary lever support
32. Connecting rod pins
33. Epicycloidal satellite axis
34. Epicycloidal first ring gear
35. Epicycloidal planetary
36. Progressive circular ramp
37. Epicycloidal satellite
38. Circular slide rule
39. Torque valve cone
40. Valve closing/opening cone
41. Shared valve shank
42. Valve cap
43. Distributor's control lever
44. Hydraulic fluid galleries
45, 45'. Valve detents
46, 46'. Valve push rod
47, 47'. Valve seat support
48. Closed-circuit four-way distributor
49. Drive cam
50. Hydraulic fluid accumulator
51. Valve detent washer
52. Right valve seat ball
53. Left valve seat ball
55. Torque regulating spring
56. Ruler/ramp attachment hole
57. Valve sleeve
58. Lag hole
59. Valve plunger
78. Bearing support threaded hole
79. Flange
86. Top rotation fin
87. Bottom rotation fin
88. Bearing support screw fastener/fin
89. Threaded cylinder with bolts
90. Piston hole
91. Bearing wrench hole
92. Connecting bolt bearing wrench with hydraulic wrench
93. Support screw bearing nut
94. Support's bearing nut
95. Bearing wrench
96. Receiving support
97. Bearing support
98. End detent screw

99. Hydraulic wrench
100. Circular slide rule mechanism

DETAILED DESCRIPTION OF THE INVENTION

As shown in FIG. 1, the forward movement of the two-speed piston (14) is executed by pushing the lever (29), which is coupled to the support (30) through the bolt (27), the support (30) is coupled by a latch and pushes the spherical two-head connecting rod (15), which in turn performs the function of ball on the two-speed piston (14).

The two-speed piston (14) exerts pressure which opens the valves (13, 13C), and though a butt (16) the hydraulic fluid is supplied to the pressure valve (39) and to the piston (7), thus executing the power piston (2) shift.

Figure 3:
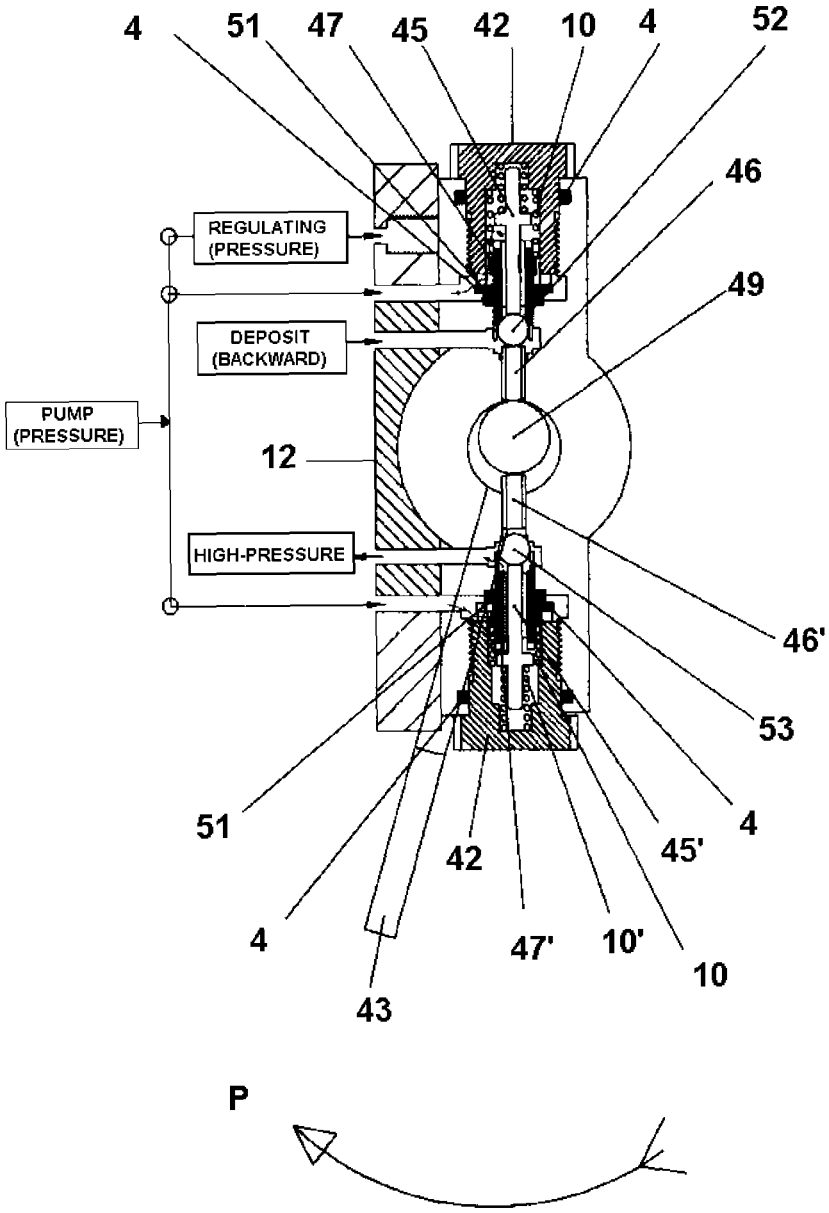
FIG. 3 shows the valve block (12) of the casing (1) of the hydraulic wrench, in longitudinal cut, at its operating position of piston stroke.
Figure 3A:
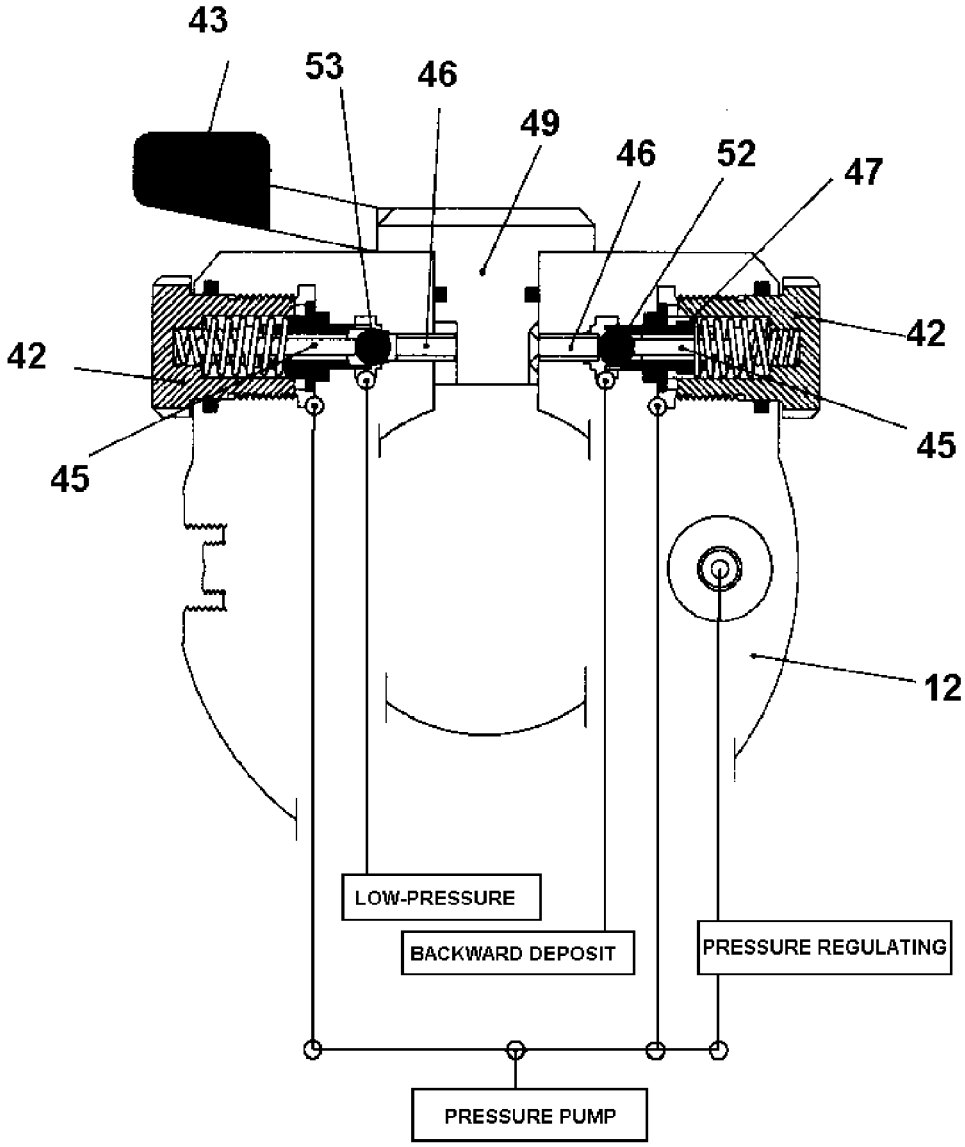
FIG. 3A shows the valve block (12) of the casing (1) of the hydraulic wrench, in cross-sectional cut, at its operating position of piston stroke.

As shown in FIGS. 1 and 3, the casing (1) comprises a closed-circuit four-way distributor (48), having the function of actuating the piston through the distributor's control (43) in forward movement position. The distributor's control lever (43) is coupled to the control cam (49), which drives the valve push rods (46, 46'), which in turn push the valve (52), into the valve detents (45, 45') and to the valve seat supports (47, 47'). At the same time, it pushes the valve push rod (46') backwards, the valve (53), the valve detent (45') and the valve seat support (47'), remaining the circuit four-way distributor (48) closed, as illustrated in FIGS. 3 and 3A, and disposed for performing the forward movement of the piston.

Once the piston (2) has reached the end of its stroke, the hydraulic fluid pushes the retractable detent (18) and opens the valve (17) so that the hydraulic fluid starts the backward movement.

Figure 4:
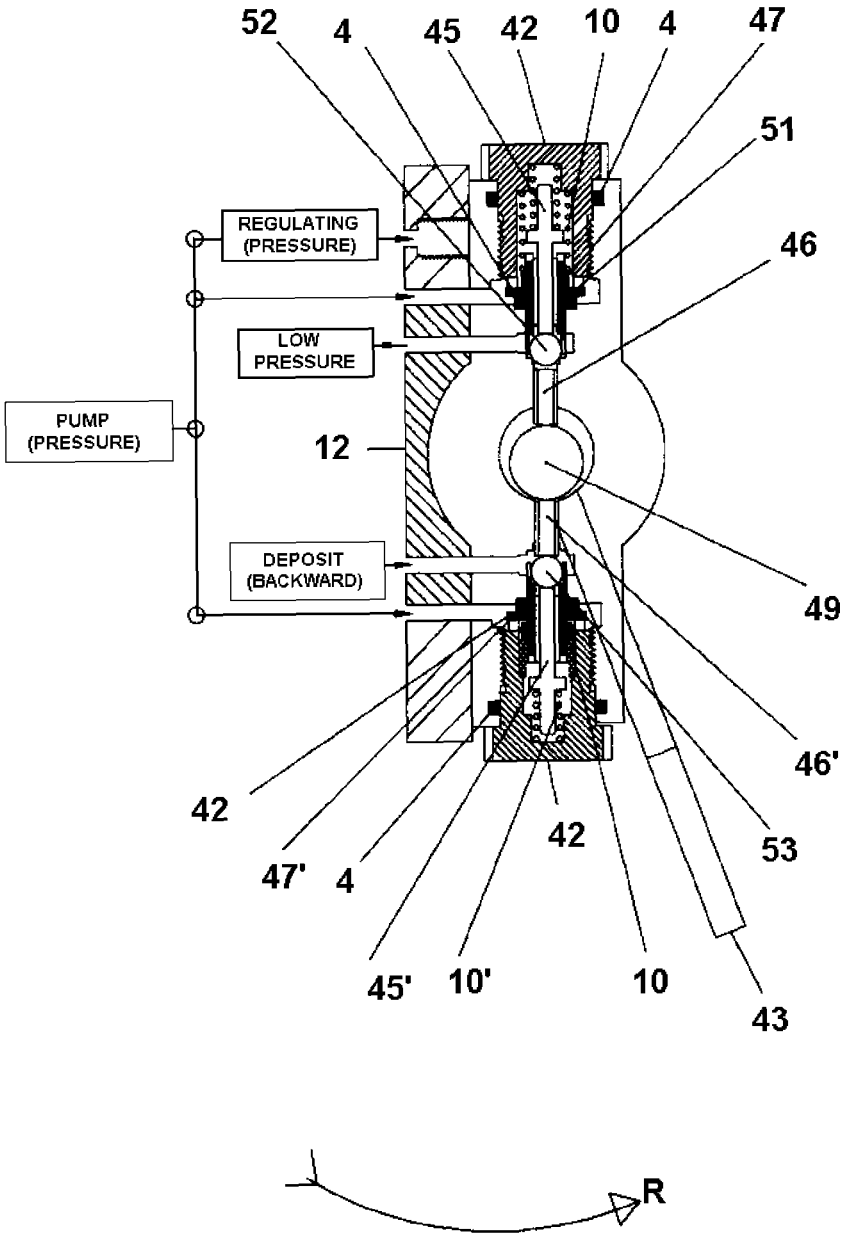
FIG. 4 shows the valve block (12) of the casing (1) of the hydraulic wrench, in longitudinal cut, at its operating position of piston backward movement.

For the backward movement of the power piston (2), the distributor's control lever (43) must be oriented to the position of the drive lever (29) (FIG. 4). The distributor's control lever (43) is coupled to a cam (49). The cam (49) acts on the push rod (46) which in turn acts on the valve (13), while causing the valve seat support to move backwards (47), resulting in the closing of the pressure circuit valve (13), and in turn opening the return circuit.

the closed circuit four-way distributor (48) also moves the piston backwards. The distributor control lever (43) is placed in the retractable position, as illustrated in FIG. 4. When attached to the control cam (49), this actuates the push rod (46'), which in turn pushes the valve (53), to the valve detent (45'), and to the valve seat support (47'). At the same time, it pushes the valve push rod backwards (46), the valve (52), the valve detent (45) and the valve seat support (47), remaining the closed circuit four-way distributor (48) closed, as illustrated in FIGS. 4 and 4A, and disposed for performing the backward movement of the piston.

Figure 4A:
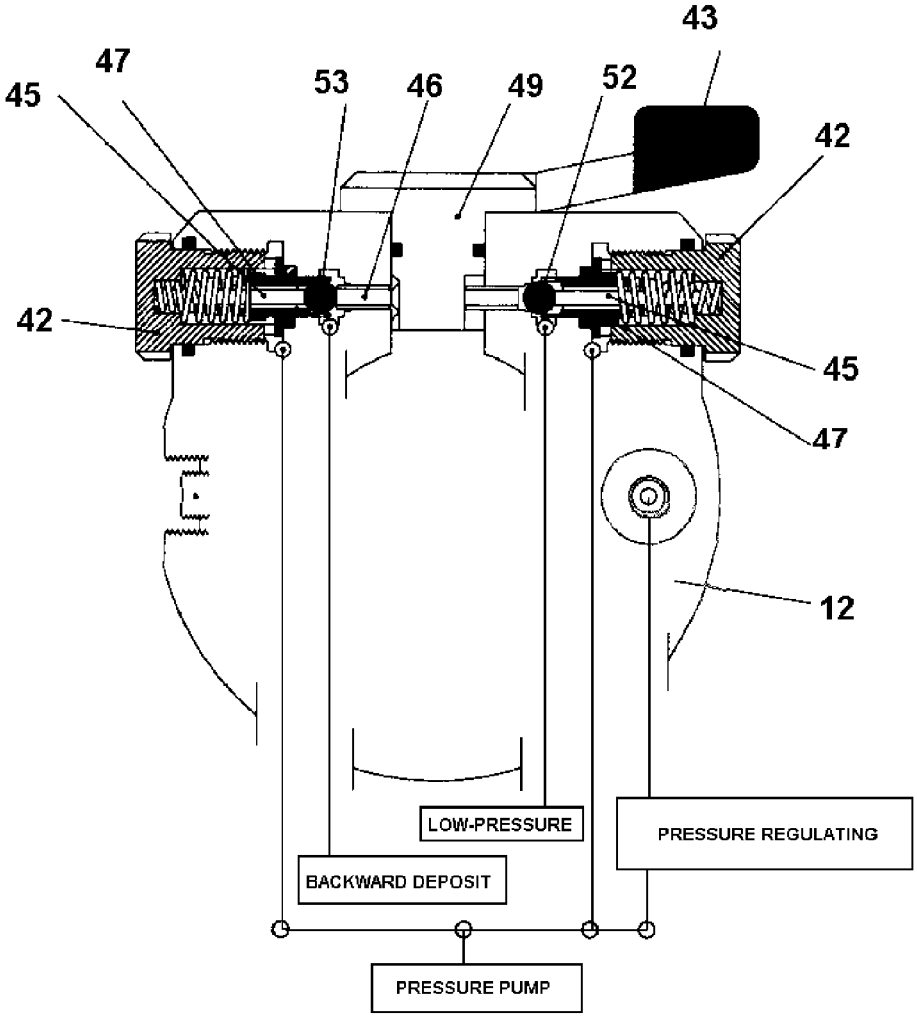
FIG. 4A shows the valve block (12) of the casing (1) of the hydraulic wrench, in cross-sectional cut, at its operating position of piston backward movement.
Figure 5:
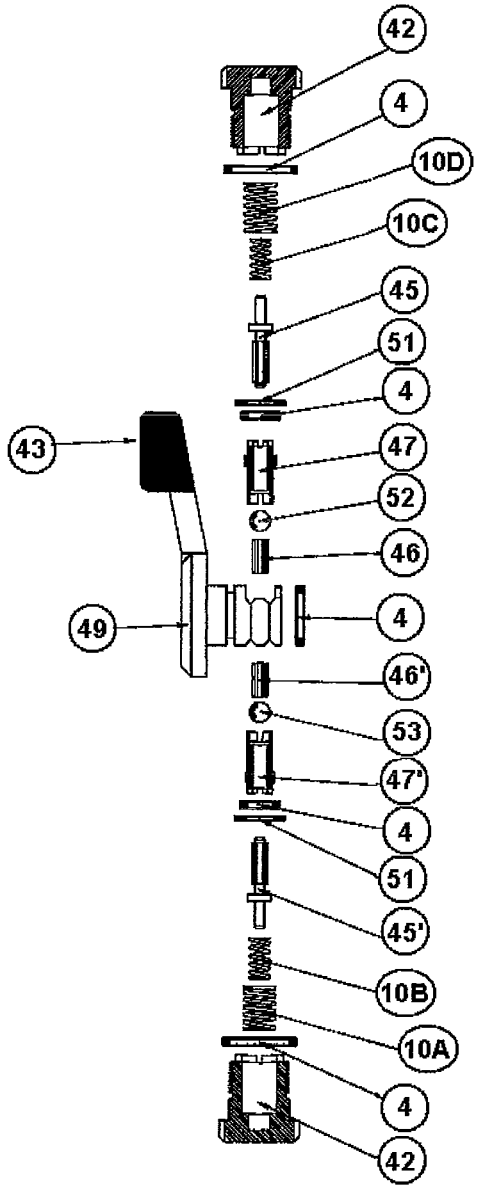
FIG. 5 is an exploded view of the elements constituting the supply device.

The closed-circuit four-way distributor (48) is illustrated in detail in FIGS. 3 and 3A, which correspond to the forward movement of the piston, as well as in □ FIGS. 4 and 4A, which correspond to an exploded view of the elements constituting the supply device. The distributor's control lever (43) and the control cam (49) are coupled, thus forming the same body. That is, upon rotating to the piston forward movement position, the lever (43) rotates concurrently with the cam (49); and upon rotating to the backward piston movement the same happens.

The manual drive four-way and two-ball valves, high-pressure hydraulic supply device (48) wherein a actuating lever (43) in position of piston forward movement (FIGS. 3 and 3A) is solidarily coupled to a cam (49), which transmits the movement to the valve push rod axis (46), which in turn moves the ball (52) which pushes the valve detent (45) and also the seat support (47). The valve cap (42) abuts against the washer (51) which fixes the moisturetight seal (4). A spring (10A) keeps the position of the ball (52), another spring (10B) keeps the position of the valve seat support (47). The pressure of the pump enters through a gallery (P) (FIG. 2B) until the top portion of the valve seat support (47) pressing in a way of piston on the ball (52) and creating a perfect moisturetightness. At the opposite side, the spring (10C) forces the valve detent axis (45') to displace the ball (53) and also the valve seat support (47'), both move forward leaving the way of the "pump (pressure)" free and communicated with the way of "high pressure" (FIGS. 3 and 3A).

When rotating the lever (43) into the rear portion (FIGS. 4 and 4A) the function of the two valves is reversed. The ball valve (53) remains closed now, and the ball valve (52) on the contrary remains open.

Figure 2:
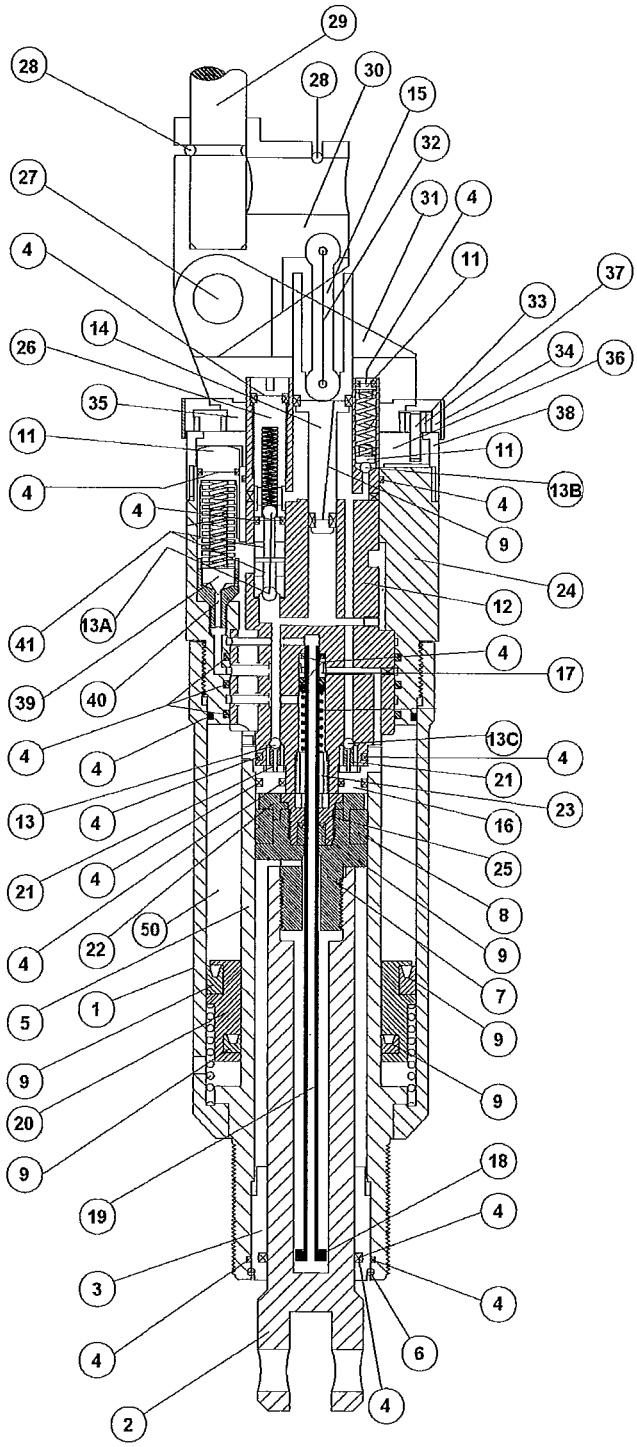
FIG. 2, shows a longitudinal cut of the casing (1) of the hydraulic wrench, in side view.

Regarding FIGS. 1 and 2, the casing (1) comprises also a hydraulic fluid accumulator (50) having a space which is outlined by the casing (1) and the piston sleeve (5), which performs the function of a fluid deposit. The fluid accumulator (56) is in the same cylinder that houses the power piston (2). The accumulator (20) piston (7) is longitudinally displaced due to the effect of the force of the accumulator spring (10'), remaining sealed by the moisturetight collars (9).

The accumulator spring (10') exerts a force on the accumulator piston (20) so that it constantly provides the hydraulic fluid to the pump, in order to be able to operate in any position with regards to the working drawing, without the pump losing its priming. Because it is a double effect piston, the entrance of fluid to the accumulator at return path is under pressure.

Figure 2A:
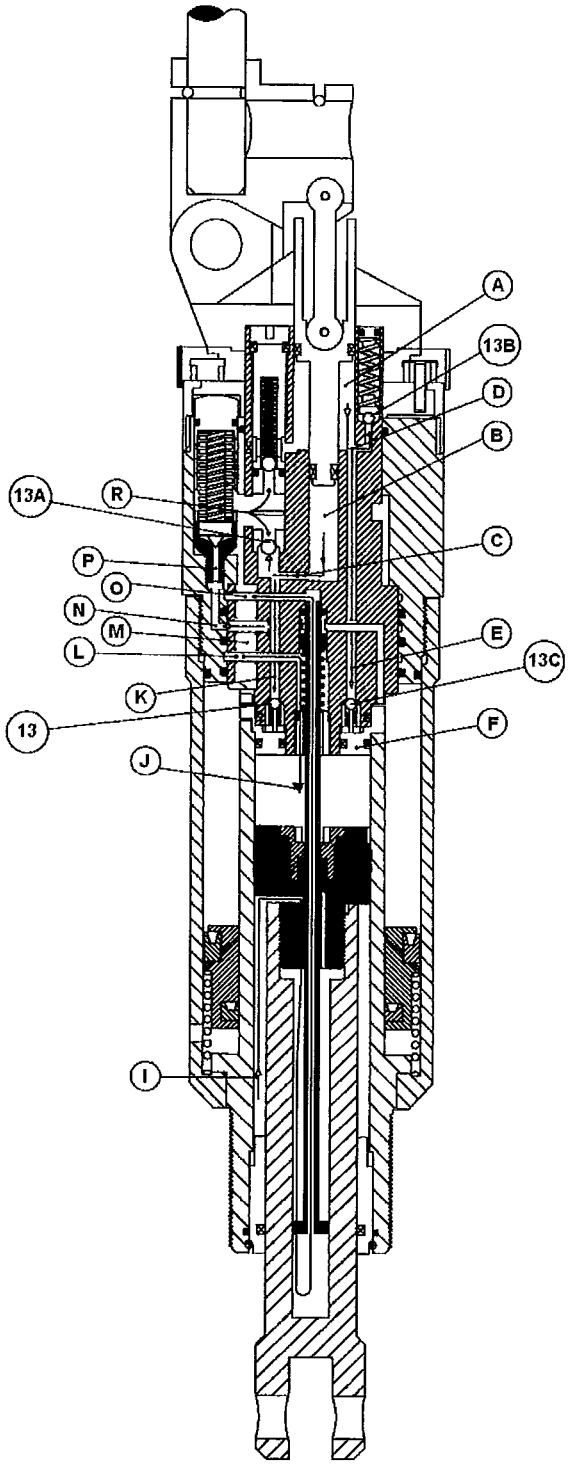
FIG. 2A, is another longitudinal view of the casing (1) of the hydraulic wrench in side view.
Figure 2B:
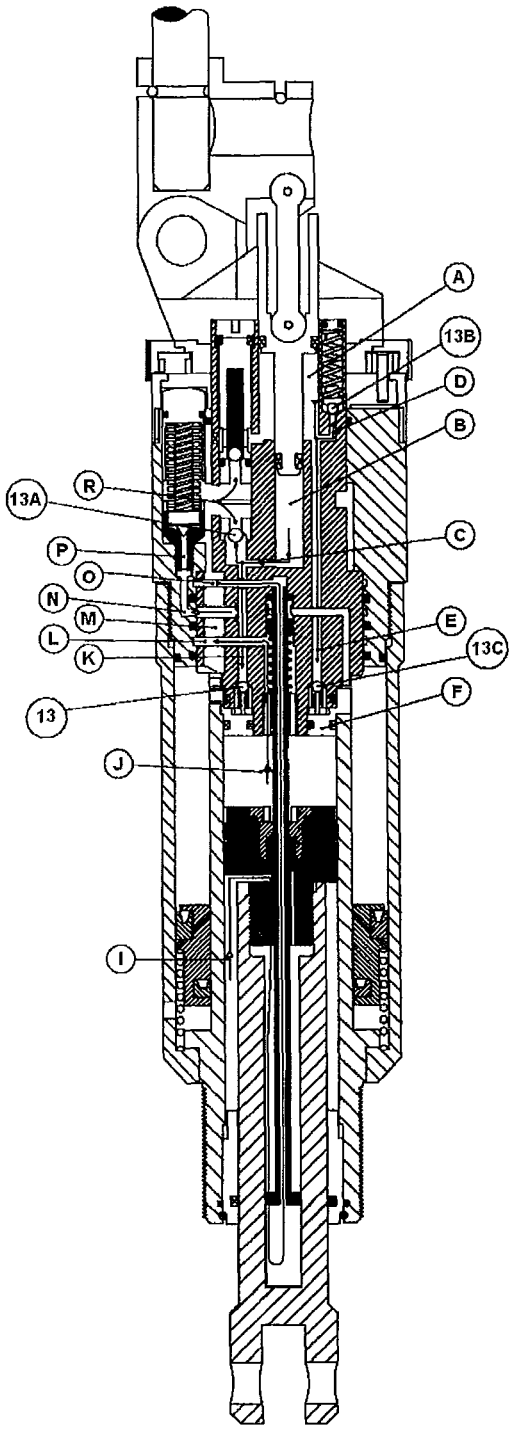
FIG. 2B, is another longitudinal cut of the casing (1) of the hydraulic wrench in side view.

The displacement of hydraulic fluid is illustrated in FIGS. 2A and 2B, wherein in order for the piston to move forward (2) upon actuating the lever (29) which is coupled to the support (30) by the bolt (27), the support (30) pushes the spherical two-head connecting rod (15), which in turn performs the function of ball on the two-speed piston (14) by pressing the hydraulic fluid.

If the pressure is lower than a given pressure, for example 100 bar (1st speed, fast) the fluid is displaced from the sleeve of smaller diameter (B), passing through gallery E and opening the valve 13C, heading towards gallery F, where the fluid displaced by the sleeve B is found, which goes into gallery K through gallery C, opening the valve (13), and encountering the chamber fluid coming from the greater diameter sleeve (A), all the fluid goes from there to gallery N, which communicates with gallery P of the torque control valve (40), also communicated with the distributor block (48). The hydraulic fluid passes from the distributor block (48) to gallery L, passing through gallery J from where the hydraulic fluid presses the piston head (7).

If the pressure is greater than the given pressure, for example 100 bar (2nd speed, slow), the valve 13B opens and the hydraulic fluid goes to the return, the valve 13C remains closed.

The hydraulic fluid of chamber C goes to gallery K and opens the valve 13, passing through gallery F and going from here to gallery N communicating with gallery P (torque control) and with the distributor control (48), passing to gallery L and from here to chamber J where it pushes the piston (7).

Gallery M is supplied by the accumulator (50), immediately after gallery M supplies gallery R of main entrance for the supply of the piston (7).

For the piston return (7), when the hydraulic fluid of chamber A and chamber B is compressed by the piston action, it passes galleries C, D and K, opening the valves 13 and 13C (13A and 13B remain closed), passing hydraulic fluid to gallery F and from this to gallery N, immediately after, it flows to gallery P and the distributor block (48); from here, it passes to gallery O and from this to gallery I, exerting pressure on the opposite face of the piston (7), thus executing the reverse forward of the piston.

Figure 6:
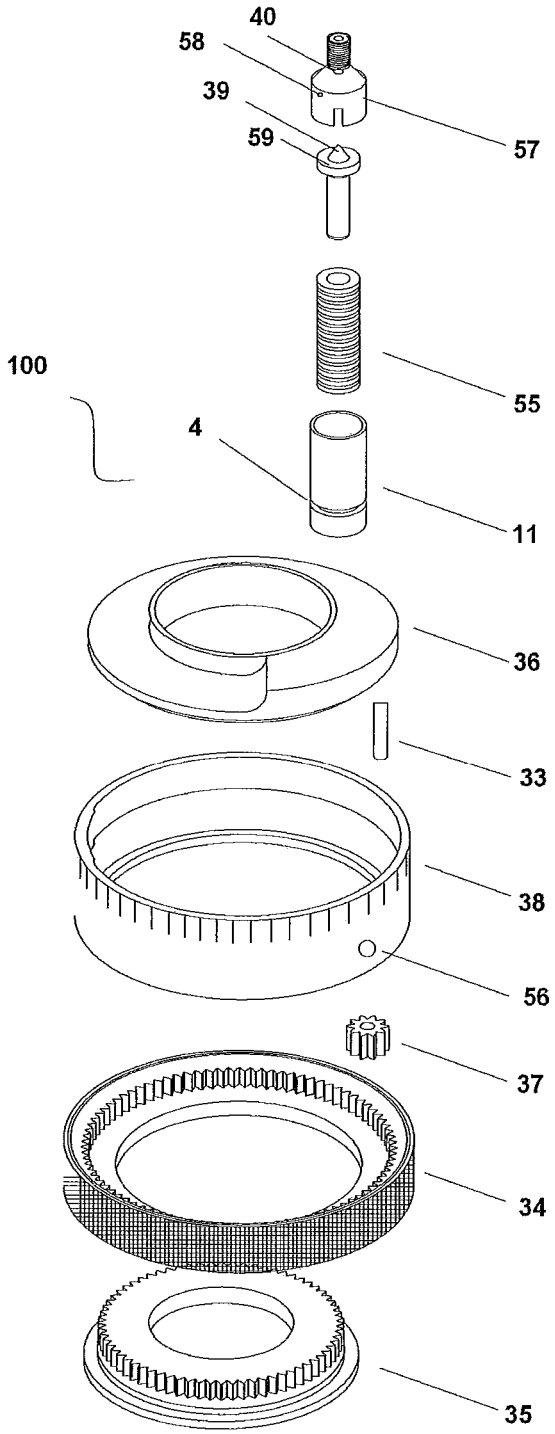
FIG. 6, shows the fluid accumulator (50) of the casing (1) of the hydraulic wrench.

As illustrated in FIGS. 2 and 6, the hydraulic wrench has a torque selection and regulation device comprising a circular slide rule mechanism (100), which performs the function of providing torque accuracy, at the same time it establishes the maximum torque which may be applied.

The circular slide rule mechanism (100) is permanently incorporated into the valve block (24), so that the valve closing/opening cone (40) of torque regulation is in permanent connection with the existing pressure in the circuit that has generated the pump through manual drive of the lever (29). That is, the torque selection and regulation device is part of the valve block (24), through the valve closing/opening cone (40), which remains coupled to the block through a threaded joint (24).

The valve closing/opening cone (40), or cone valve seat, is a stationary element of attachment with the mobile element (linear movement) of the torque selection and regulation device. The mobile elements, which have a linear movement, are the torque valve cone (39), the regulation spring (10A) and the ramp/spring contact cylinder (11). Obviously, the progressive circular ramp (36) only has one rotational movement as the different components of the del epicycloidal reducer.

In reference to FIGS. 1, 2, 2A and 2B, when the two-speed piston (14) starts to simultaneously compress the hydraulic fluid in the two chambers of different diameter, the fluid is displaced from chamber B (lower diameter or high pressure sleeve, 2nd speed, slow) and from chamber A (higher diameter or low pressure sleeve, 1st speed, fast) into galleries E and K, opening valves 13 and 13C. From this point on, the hydraulic fluid passes through the gallery F, and then into a gallery N (not illustrated), continuing until gallery P (torque control and safety discharge), communicating with the distributor (48), and continuing with gallery L, ending in gallery J in order to press the piston (7).

The two chambers A and B act simultaneously when the pressure is lower than a given pressure, for example 100 bar, when the pressure is higher than the given pressure, chamber B acts by pressing and chamber A is disabled to exerting pressure, sending the fluid through the valve return 13B which opens and sends the fluid to the deposit.

For the selection of a specific torque, the epicycloidal first ring gear arrangement (34) (FIG. 6) is manually rotated, which transmits the rotation to the circular slide rule (38) through the satellite (37) and the epicycloidal planetary (35). The circular slide rule (38) rotates until the die cut marking "0" (static reference point) in the valve block (24) of the hydraulic wrench (99).

The selection of the torque wrench is made by matching the scale markings of the circular slide rule (38) with the static reference point "0".

The circular slide rule (38) is movable and transmits the circular movement to the progressive circular ramp (36) through the satellite (37) and the axis (33) which is coupled to the circular ramp (36). The circular slide rule (38) coupled to a circular ramp (36) through a set screw mounted in the threaded hole (56), whereby upon loosening the screw (not illustrated), the circular slide rule (38) may rotate by moving backward or forward with respect to "0", without having to dismount any pieces.

The progressive circular ramp (36) transforms the circular movement into linear movement so that the contact cylinder (11) acts linearly on the spring (55) tightening the valve closing/opening cone (39). The valve closing/opening cone (39) acts on the valve seat (40) in such a way that, once the preselected pressure is reached (the pressure is proportional to the torque marked in the circular slide rule (38)), the valve closing cone moves backwards, thus opening the valve. Upon the opening of the valve seat (40) the hydraulic fluid passes to the zone comprised between the valve sleeve (57) and the valve plunger (59) creating a sensitive trigger of torque reached signal, for sudden pressure drop, remaining the actuating lever (29) "loose". After 1 or 2 seconds the valve is again automatically set up for a new drive.

The lag hole (58) performs the function of delaying time before the valve closing/opening cone (39) closes the valve again, at the same time regulating the exit of hydraulic fluid once the valve seat has been opened.

The ruler/ramp attachment hole (56) is a threaded hole for installing a screw and fixing the circular slide rule (38) and the progressive circular ramp (36) so that they rotate in unison.

The moisturetight seal (4) performs the function of isolating the hydraulic fluid from the outside once the valve seat (40) is open.

Figure 7:
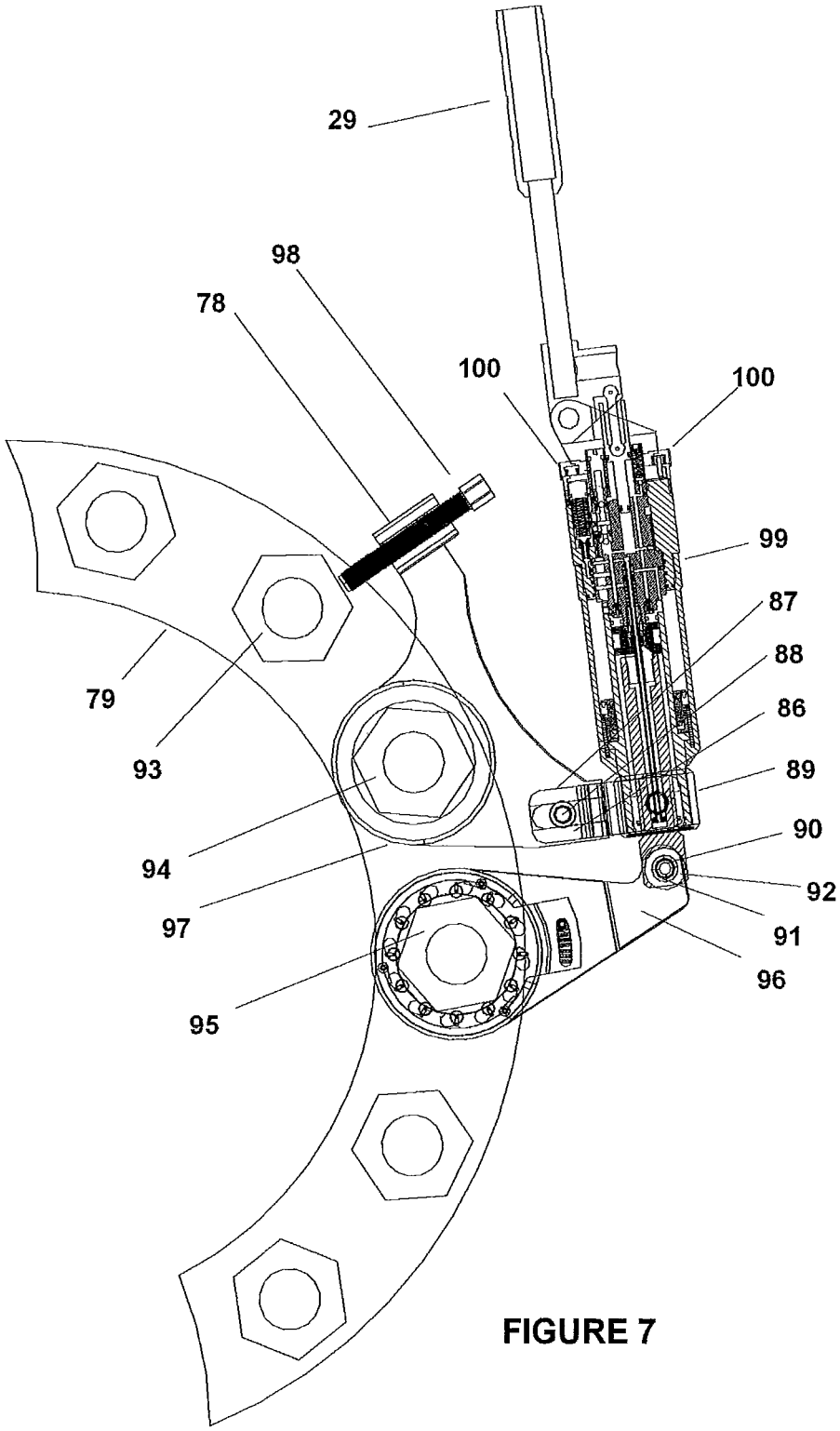
FIG. 7 shows the circular slide rule mechanism (100) with all of its components.

As illustrated in FIG. 7, the hydraulic wrench (99) may interact with the receiving support (95) of the bearing wrench (96) and the bearing support (97). In order to operate on a flange coupling (79) the receiving support (95) of the bearing wrench (96) is inserted in the nut (95) for tightening thereof, once inserted, the receiving support (95) of the bearing wrench (96) the bearing support (97) is introduced into a bearing nut (94) and the end detent screw (98) is set by tightening it to or loosening it from the threaded hole (78) from the bearing support (97), depending on the proximity or remoteness of the screw (98) bearing nut (93). Two pivoting points are necessary in order to tighten or loosen a nut through the bearing wrench (95); if only the support (97) is inserted in the nut (94), it would rotate on itself and would not be able to tighten or loosen the screw (95). In order to loosen the nut, it is necessary to rotate the entire hydraulic wrench assembly (99), the bearing support (97) and the bearing wrench (95).

In order to start the nut tightening, the manual drive lever (29) is operated, which causes the receiving support (96) of the bearing wrench (96) to move forward through the coupling to the piston hole (90) by the hole (91) of the bearing wrench. Thus, the bolt (92) couples the bearing wrench (96) to the hydraulic wrench (99) in such a way that the exchange of bearing wrenches may be executed quickly depending on the size of the nut. A different bearing wrench must be used for each nut size.

Once the piston stroke finishes, if the nut is not sufficiently tightened, the double-effect piston is moved backwards to start a new stroke, as if it was being tightened, by simply rotating the distributor lever.

Therefore, those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A torque-regulated manual drive hydraulic wrench for tightening and loosening, comprising:

a casing (1);

a manual drive lever (29) coupled to one end of the casing (1), and a power piston (2) coupled to the opposite end of the casing (1);

a two-speed piston (14) within the casing (1);

a closed-circuit, four-way distributor (48) within the casing (1);

wherein the piston forward movement stroke (14) is carried out through the lever thrust (29), which is attached to a support (30), the support (30) pushing in turn a spherical, double-head connecting rod (15), which performs the function of ball over the piston (14);

the piston forward movement (14) pushes a hydraulic fluid housed in a fluid accumulator (50), causing the hydraulic fluid to open the valves (13, 13C), and through a butt (16) hydraulic fluid is provided to a pressure valve (39), which urges a piston (7), that in turn pushes a power piston (2) causing it to mover forward; and wherein the backward movement of the piston is made by a distributor control lever (43), which is directed towards the drive lever (29) position, the distributor control lever (43) is coupled to a cam (49) which acts on a push rod (46) which in turn acts on the valve (13), at the same time it causes the valve seat support to move backwards (47), which results in the closing of the pressure circuit valve (13), which in turn opens the return circuit.

2. The manual drive hydraulic wrench according to claim 1, wherein the fluid accumulator (50) has a gap which is outlined by the casing (1) and a piston sleeve (5), and operates as fluid deposit.

3. The manual drive hydraulic wrench according to claim 1, further comprising a torque selection and regulation device having a circular slide rule mechanism (100) comprising:

a epicycloidal planetary (35), an epicycloidal first ring gear (34), an epicycloidal satellite arrangement (37), a circular ruler (38) with a hole (56), a satellite axis (33) attached to the progressive circular ramp (36), a ramp/spring contact cylinder (11) with a moisturetight seal (4), a torque regulator spring (55) which houses a plunger or valve (59) having at one of its ends a valve closing/opening valve, a valve sleeve (57), having at one of its ends a valve seat (40) and a lag hole (58);

wherein the circular slide rule (38) is movable and transmits the circular movement to the progressive circular ramp (36) through the satellite (37) and an axis (33) which is attached to the circular ramp (36); and wherein the circular slide rule (38) is coupled to a circular ramp (36) through a set screw mounted in the threaded hole (56), so that upon loosening the screw, the calibrated slide rule (38) may rotate by moving backward or forward with respect to a die cut or labeled reference frame "0" in the valve block (24), whereby the hydraulic wrench may be calibrated from the outside, without having to dismount any pieces.

4. The manual drive hydraulic wrench according to claim 3, wherein the progressive circular ramp (36) transforms the circular movement into linear movement so that the contact cylinder (11) acts linearly over the spring (55) that tightens the valve closing/opening cone (39).

5. The manual drive hydraulic wrench according to claim 3, wherein the valve closing/opening cone (39) acts on the valve seat (40) in such a way that upon reaching the preselected pressure, this pressure is proportional to the torque marked in the circular slide rule (38), the valve closing cone moves backwards thus opening the valve, once open, the hydraulic fluid passes to the zone comprised between the valve sleeve (57) and the valve plunger (59) creating a sensitive trigger of torque reached signal.

6. The manual drive hydraulic wrench according to claim 1, wherein the hydraulic wrench is used to tighten/loosen flange nuts, for which the piston shaft (2) of the hydraulic wrench is coupled to a receiving support (96) of a bearing wrench (96), and to a bearing support (97), and the bearing wrench receiver support (96) is in turn coupled to a bearing wrench (95).

7. The manual drive hydraulic wrench according to claim 1, wherein the manual drive, four-way and two ball-valve, high-pressure, hydraulic supply device (48) comprises:

an actuating lever (43) which is solidarily coupled to a cam (49), which transmits the movement to the valve push rod axis (46), in order to move it from a forward position to a backward position, which in turn moves the ball (52) which pushes the valve detent (45) and also the seat support (47);

a valve cap (42) which abuts against a washer (51) which fixes the moisturetight seal (4); a spring (10A) keeps the position of the ball (52), a spring (10B) that keeps the position of the valve seat support (47);

wherein the pressure of the pump enters through a gallery (P) until the top portion of the valve seat support (47) pressing in a way of piston on the ball (52) and creating a perfect moisturetightness, at the opposite side, the spring (10C) forces the valve detent axis (45') to displace the ball (53) and also the valve seat support (47'), both moving forward leaving the way of the pump (pressure) free and communicated with a way of high pressure; and wherein upon rotating the lever (43) into the rear portion the function of the two valves is reversed.

8. The hydraulic tool for spreading and aligning flanges according to claim 1, wherein the hydraulic fluid is hydraulic oil.

* * * * *